US006643845B2

(12) United States Patent
O'Dea et al.

(10) Patent No.: US 6,643,845 B2
(45) Date of Patent: Nov. 11, 2003

(54) MAGNETIC WORK GLOVE

(75) Inventors: Thomas J. O'Dea, Sioux Falls, SD (US); Thomas S. Jellema, Sioux Falls, SD (US)

(73) Assignee: Handyglove, LLC, Sioux Falls, SD (US)

( * ) Notice: Subject to any disclaimer, the term of this patent is extended or adjusted under 35 U.S.C. 154(b) by 0 days.

(21) Appl. No.: 10/122,446

(22) Filed: Apr. 13, 2002

(65) Prior Publication Data

US 2002/0148031 A1 Oct. 17, 2002

Related U.S. Application Data

(60) Provisional application No. 60/284,386, filed on Apr. 16, 2001.

(51) Int. Cl.[7] ..... A41D 19/00

(52) U.S. Cl. ..... 2/161.6; 2/160; 224/183

(58) Field of Search ..... 2/160, 167, 161.6, 2/16, 20, 21, 161.1, 163, 161.8, 910, 917; 206/818; 224/183, 218, 901.8; 600/9, 15

(56) References Cited

U.S. PATENT DOCUMENTS

| | | | | |
|---|---|---|---|---|
| 1,174,887 A | | 3/1916 | Meriwether | |
| 3,636,568 A | | 1/1972 | Stuner | |
| 4,325,504 A | | 4/1982 | Amani | |
| 5,593,073 A | | 1/1997 | Finnegan | |
| 5,715,539 A | | 2/1998 | Benecki et al. | |
| 6,119,271 A | * | 9/2000 | Byon | 2/161.2 |

FOREIGN PATENT DOCUMENTS

| | | | | |
|---|---|---|---|---|
| GB | 2168898 | * | 7/1986 | A61N/1/42 |

* cited by examiner

*Primary Examiner*—Katherine Moran
(74) *Attorney, Agent, or Firm*—Gold & Rizvi, P.A.; Glenn E. Gold; H. John Rizvi

(57) ABSTRACT

A work glove is provided having an enclosure, such as a pocket, pouch or like structure disposed on an interior or exterior surface of the glove body. One or more magnets are retained within the pocket for attracting and retaining work components against an exterior surface of the backside of the glove for convenient access during a construction or assembly operation.

10 Claims, 8 Drawing Sheets

MAGNETIC WORK GLOVE

CROSS REFERENCE TO RELATED APPLICATION

This application relates to the same subject matter as copending provisional patent application serial No. 60/284,386, filed by the same applicants on Apr. 16, 2001. This application claims the Apr. 16, 2001 filing date as to the common subject matter.

BACKGROUND OF THE INVENTION

1. Field of the Invention

The present invention relates generally to gloves, and more particularly to a work glove having means for magnetically attracting and retaining work components against an outer surface of the glove for easy access during an assembly, construction or other operation.

2. Description of the Prior Art

The difficulties associated with the handling of small metal components during various construction and assembly-related operations are well known. In particular, the need to use both hands simultaneously during such operations makes it difficult for workmen to hold even a small quantity of components in-hand for easy access. For example, driving a nail into a work piece initially requires two hands to start the nail into the work piece. Similarly, many assembly operations, such as the attachment of a threaded fastener to a work piece or to another threaded component, require the simultaneous use of both hands. Handling components during such operations is further compounded when a worker is required to wear gloves for hand protection, since the gloves tend to interfere with the workers ability to grip and manipulate the components. For the aforementioned reasons, workmen commonly maintain or store components in a container, apron pouch or other component holder, drawing one component at a time. The inefficiencies concomitant with continuously reaching into a component holder during the performance of a repetitive operation adds considerably to the time to perform the operation.

Accordingly, it would be desirable to provide a means for maintaining an excess quantity of components proximate to the hands of a worker in a manner enabling the worker to access the components in a quicker and more efficient manner.

SUMMARY OF THE INVENTION

The present invention provides a work glove having a pocket, pouch or other containment means disposed on an interior or exterior surface of the glove body. One or more magnets are retained within the pocket for attracting and retaining work components against a portion of the exterior glove surface.

In one aspect of the present invention, the pocket contains multiple magnets separated by a magnetically insulating material for magnetically isolating adjacent magnets from one another.

In another aspect of the present invention, the pocket is constructed by directly securing at least part of the periphery of a flexible material directly to the exterior glove surface.

In another aspect of the present invention, the pocket is constructed from upper and lower pocket layers secured to one another at least partially about their peripheries, with the pocket attached directly to the exterior surface of the glove body.

In another aspect of the present invention, the pocket is provided having means for releasable attachment to the exterior surface of the glove body.

In another aspect of the present invention, the pocket construction enables selective access to an interior pocket space.

In another aspect of the present invention, magnets are provided disposed within fingertip portions of the glove to facilitate gripping of components during a construction or assembly operation.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed to a glove for use during a construction or assembly operation, wherein the glove incorporates means for magnetically attracting and retaining work components to a glove surface. In the following written description and the accompanying drawing figures, the various embodiments of the invention are described and illustrated with respect to a left-handed glove merely for convenience. It is to be understood that the present invention is equally applicable to both left- and right-handed gloves.

Figure 1:
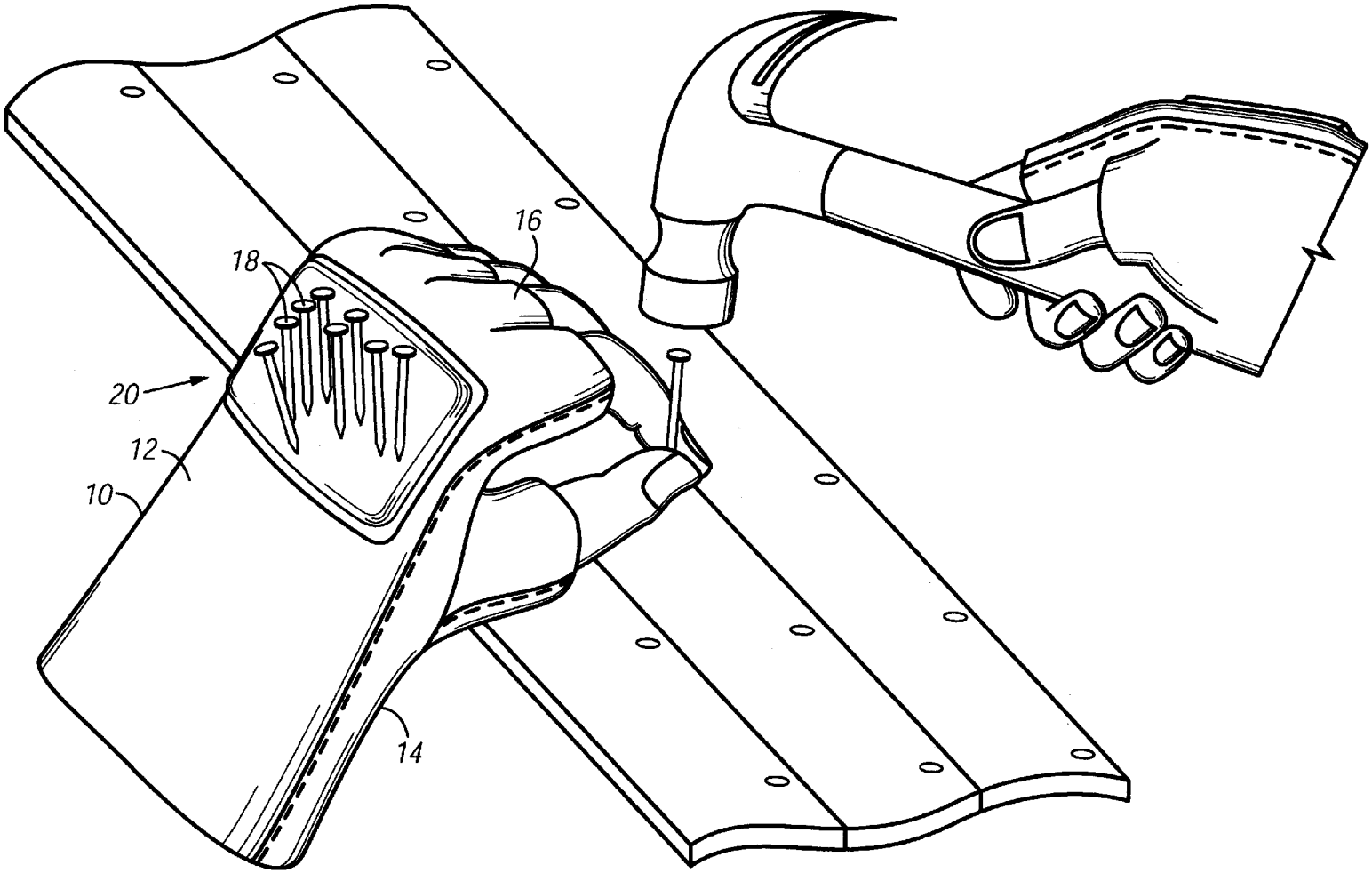
FIG. 1 is a perspective view illustrating the application of the magnetized work glove of the present invention during a typical construction operation.

Referring initially to FIG. 1, the present invention is generally directed to a glove 10 having a magnetized portion, shown generally as reference numeral 20, for attracting and retaining components 18 against a glove back surface 12 for easy access by a worker during a construction or assembly operation. The glove 10 is preferably of the flexible type commonly employed for industrial purposes such as construction and manufacturing.

The body of the glove can be constructed from any of various kinds and types of materials commonly used by glove manufacturers, including, but not limited to leather, cotton, cotton/polyester blends, vinyl, knits, rubber, rubber-coated knits and the like. The glove 10 has a back surface 12 and a front, or palm, surface 14. Finger-receiving portions 16 extend distally from the glove body in the usual manner. Preferably, the finger-receiving portions are shortened and open-ended to expose the wearer's fingers and thumb. In this manner the glove wearer is better able to grip and manipulate components and tools. Magnetized portion 20 is preferably provided attached to back surface 12. However, it will be apparent to those skilled in the art that magnetized portion 20 could just as easily be provided attached to an interior surface of the back side of the glove. In either case, the magnetized portion 20 functions to attract and maintain ferrous-containing components 18, such as nails, screws, bolts, nuts and the like, against the back surface 12 of the glove 10 for easy access during a repetitive construction or assembly operation.

Figure 2A:
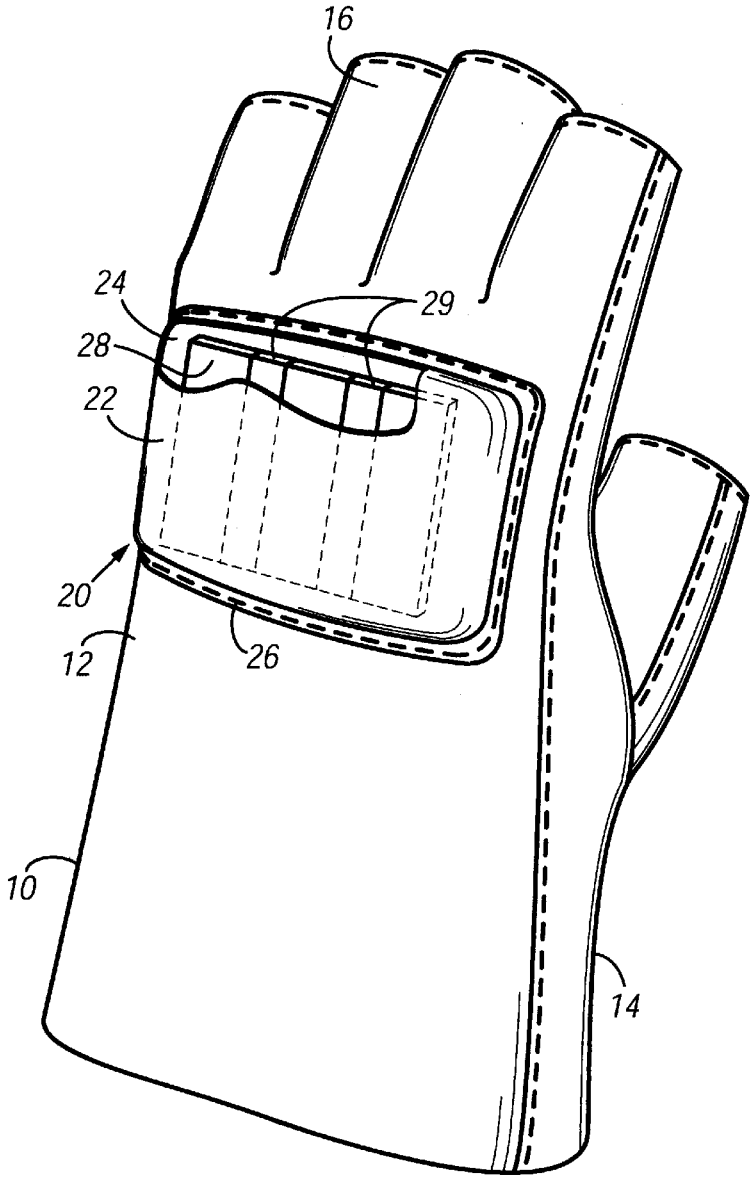
FIG. 2*a* is a partially-cutaway perspective view of one aspect of the magnetized work glove of the present invention, wherein magnets are encased in a pouch permanently affixed to a major surface of the glove.
Figure 2B:
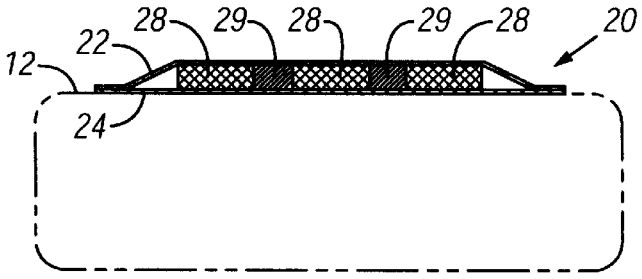
FIG. 2*b* is a cross-sectional view taken horizontally through enclosure 20 of FIG. 2*a;*

Referring now particularly to FIG. 2*a*, in one aspect of the present invention, magnetized portion 20 comprises an enclosure formed by attaching or otherwise securing peripheral portions of upper and lower layers, 22 and 24, respectively, to each other. In this embodiment of the invention, the enclosure is provided permanently attached to back glove surface 12. Upper and lower layers, 22 and 24, are attached to each other using a chemical adhesive, stitching, or any other available means. Likewise, although we prefer attachment of the enclosure 20 to the back surface 12 by peripheral stitching 26, any other known means of permanent attachment are contemplated, including, but not limited to, chemical adhesives, rivets and staples.

As will be appreciated by those skilled in the art, the enclosure could alternately be formed by attaching upper layer 22 directly to the back surface 12 of the glove body 10, thereby eliminating lower layer 24, without departing from the intended scope of the invention.

Figure 2C:
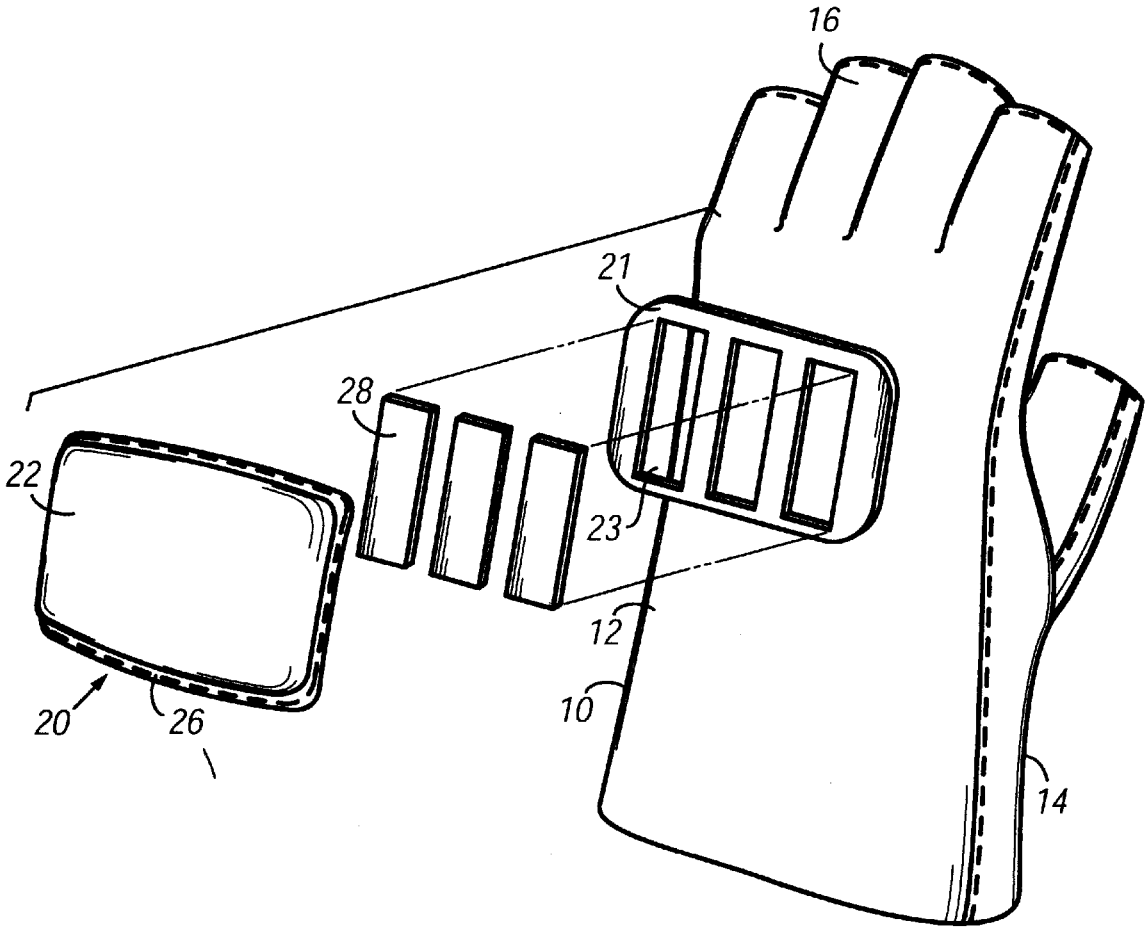
FIG. 2*c* is an exploded view of a magnetic work glove incorporating a one-piece magnetically-insulating substrate having magnet-receiving apertures, in accordance with another aspect of the present invention.
Figure 2D:
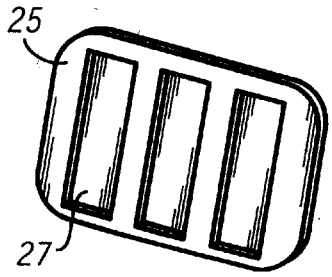
FIG. 2*d* is a perspective view of a one-piece magnetically-insulating substrate having magnet-receiving cavities, in accordance with a further aspect of the present invention.

A plurality of magnets 28 are provided contained within enclosure 20. Preferably, the magnets 28 are provided precoated with a non-corrosive material, such as, for example, epoxy, paint, nickel or rubber to minimize corrosion. The magnets 28 are positioned in a spaced-apart configuration to minimize magnetic attraction or repulsion between adjacent magnets. Additionally, an insulating layer, such as, for example, a flexible polymer or rubber substrate 29, can be provided interposed between adjacent magnets 28. The insulating layer can be in the form of individual strips of material 29 positioned between adjacent magnets 28. In lieu of using individual strips 29, the aforementioned magnet insulation can be achieved using a one-piece foam substrate 21 having apertures 23 sized and shaped for snugly receiving the magnets 28, as shown in FIG. 2*c* or, alternatively, a one-piece foam substrate 25 having cavities 27 sized and shaped for having the magnets 28 snugly seated therein, as shown in FIG. 2*d*. Furthermore, it will be appreciated that in lieu of providing a separate insulating member, portions of the upper and lower enclosure layers, 22 and 24, can be strategically attached between adjacent magnets to provide magnetic isolation. In addition to minimizing magnetic interference between adjacent magnets, the insulating portions 29 prevent the magnets from sliding about within enclosure 20.

Figure 3:
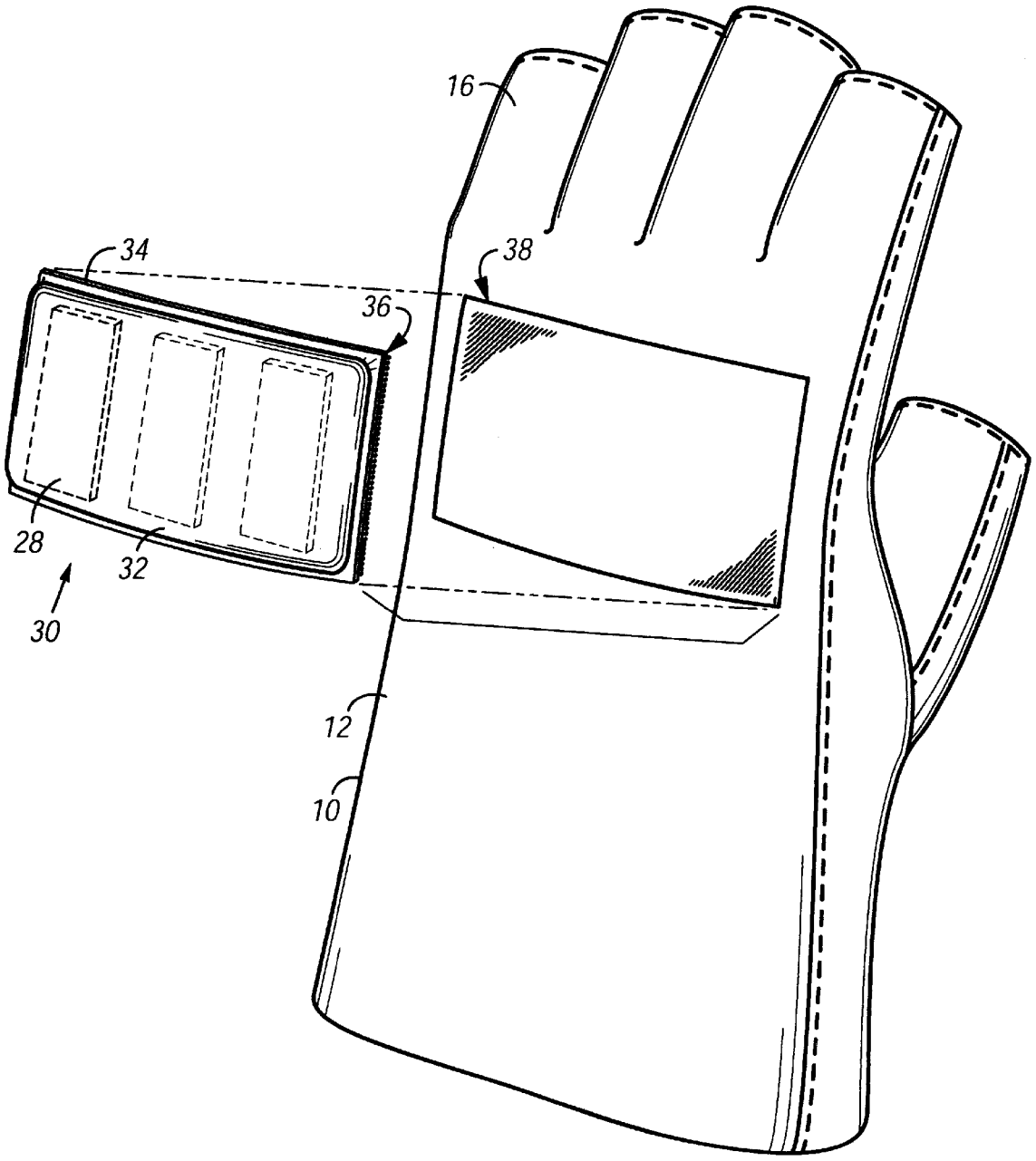
FIG. 3 is a perspective view of a further aspect of the magnetized work glove of the present invention, wherein magnets are maintained in a closed pouch incorporating a hook-and-loop type fastening system for enabling releasable attachment of the pouch to the exterior of the glove.
Figure 3A:
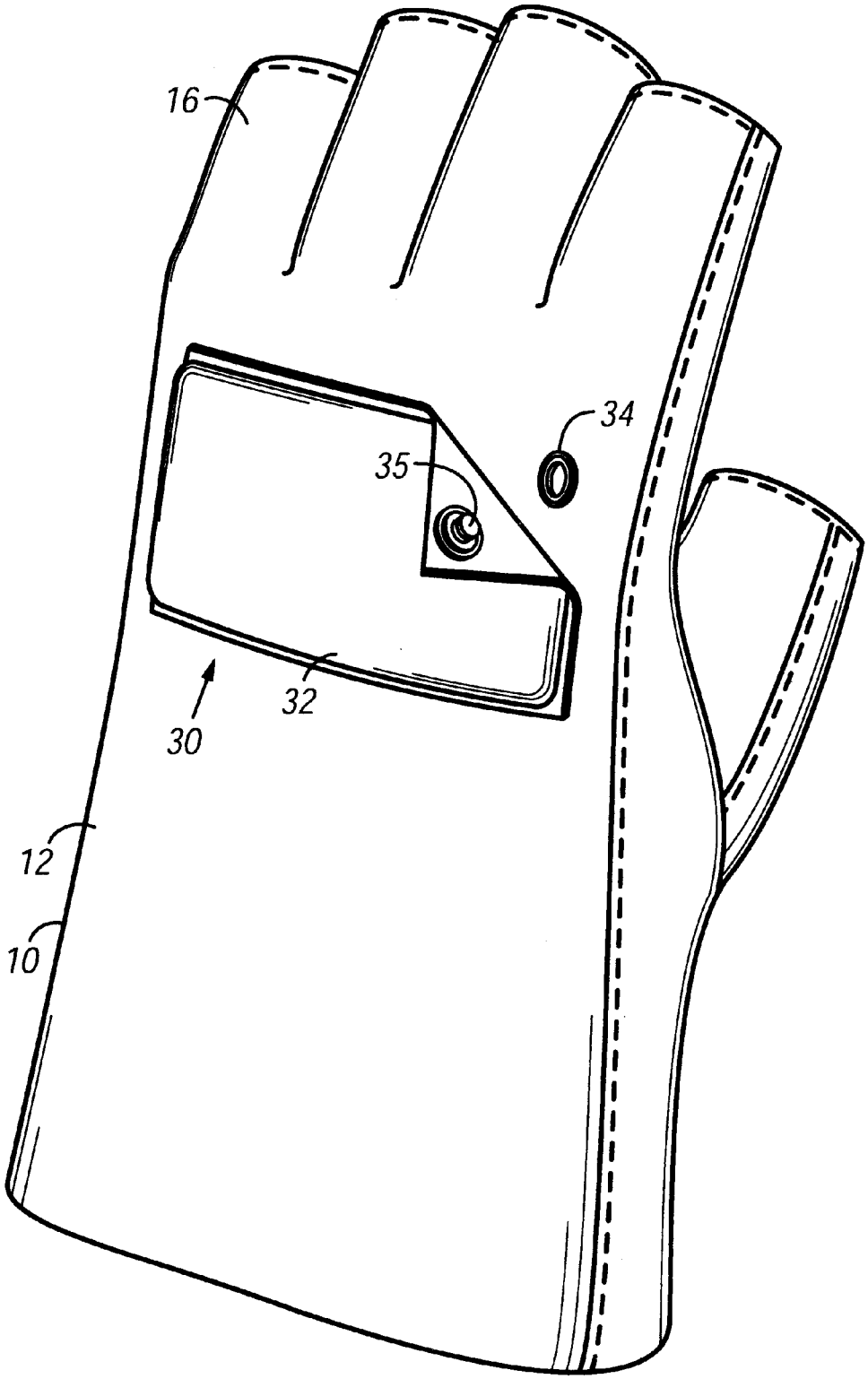
FIG. 3*a* is a perspective view illustrating the incorporation of a mechanical snap system for releasable attachment of the magnet-containing enclosure to the back surface of the glove, in accordance with a further aspect of the present invention.

Referring now to FIG. 3, in another aspect of the invention a magnet-retaining enclosure 30 is configured for releasable attachment to glove back surface 12. In this aspect of the invention, the enclosure 30 includes one or more magnets 28 interposed between topside 32 and base 34 portions of the enclosure 30. Preferably, the aforementioned releasable attachment is achieved using a hook-and-loop type fastening system, such as those sold under the trademark VELCRO. In particular, a first half of the hook-and-loop system, shown generally as reference numeral 36, is permanently affixed to the lower surface of bottom side 34. A second half of the hook-and-loop system, shown generally as reference numeral 38, is provided permanently affixed to the back surface 12 of glove 10. The first and second halves, 36 and 38, of the hook-and-loop system cooperate in a manner well known in the art to enable releasable attachment of magnet-retaining enclosure 30 to back surface 12 of glove 10. As will be apparent to those skilled in the art, alternate means for releasable attachment are possible, including, for example, mating mechanical snap members 34, 35 secured to the back surface 12 of the glove body 10 and the bottom surface of the enclosure 30, as shown in FIG. 3*a*.

Figure 4:
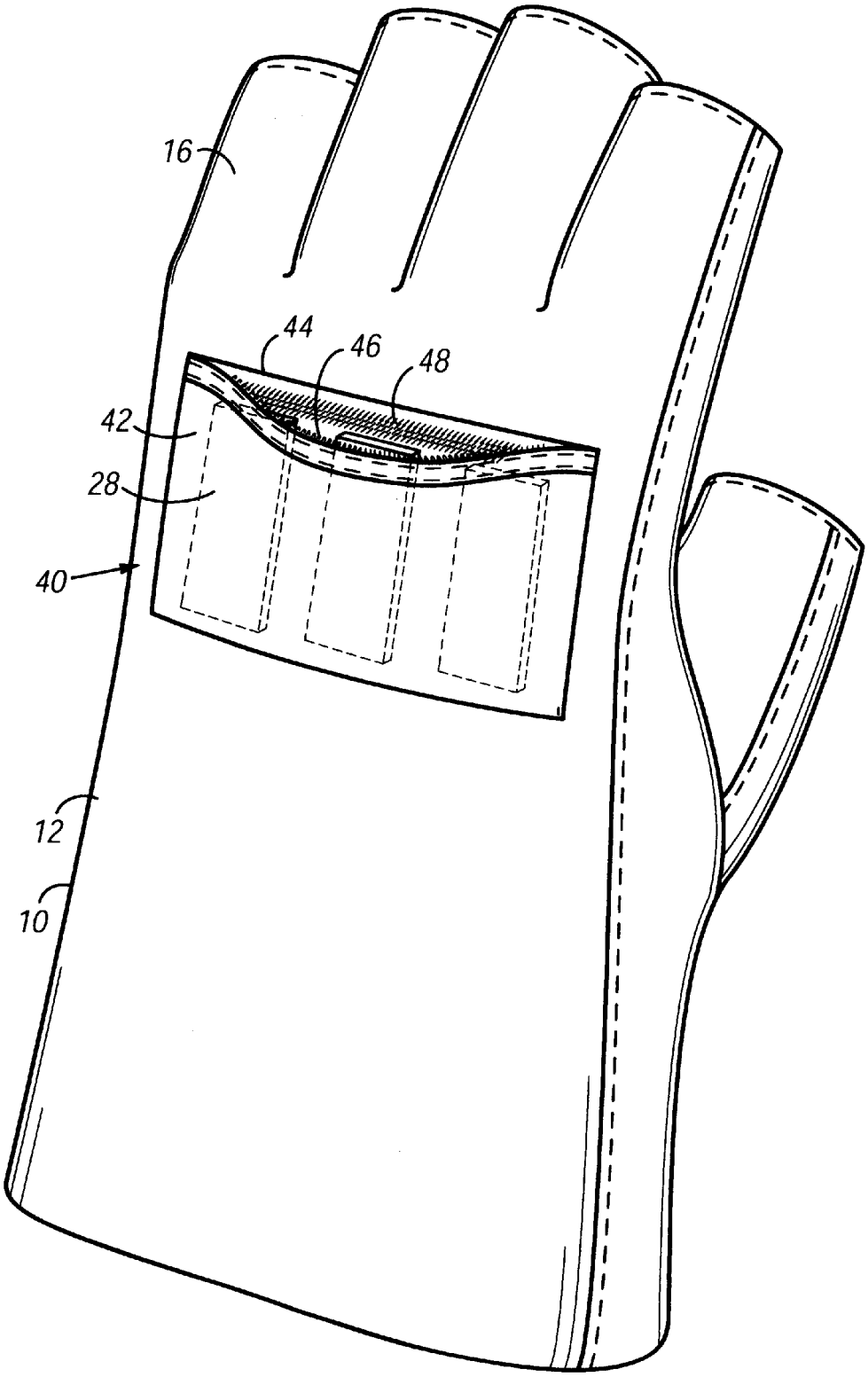
FIG. 4 is a perspective view of another aspect of the magnetized work glove of the present invention, wherein the magnet-retaining pouch can be selectively opened along a side of its periphery for enabling access to an interior pouch space.

Referring now to FIG. 4, in a further aspect of the invention a magnet-retaining enclosure is provided having the configuration of a pouch 40 having at least one peripheral portion capable of being opened for accessing an interior pouch space. Preferably, cooperating strips 46, 48 of hook-and-loop type fastener materials are disposed peripherally along the inner-facing surfaces of respective upper and lower pouch layers 42 and 44. In this manner, the inside of the pouch can be accessed to insert, remove or reposition the magnets 26.

Figure 5:
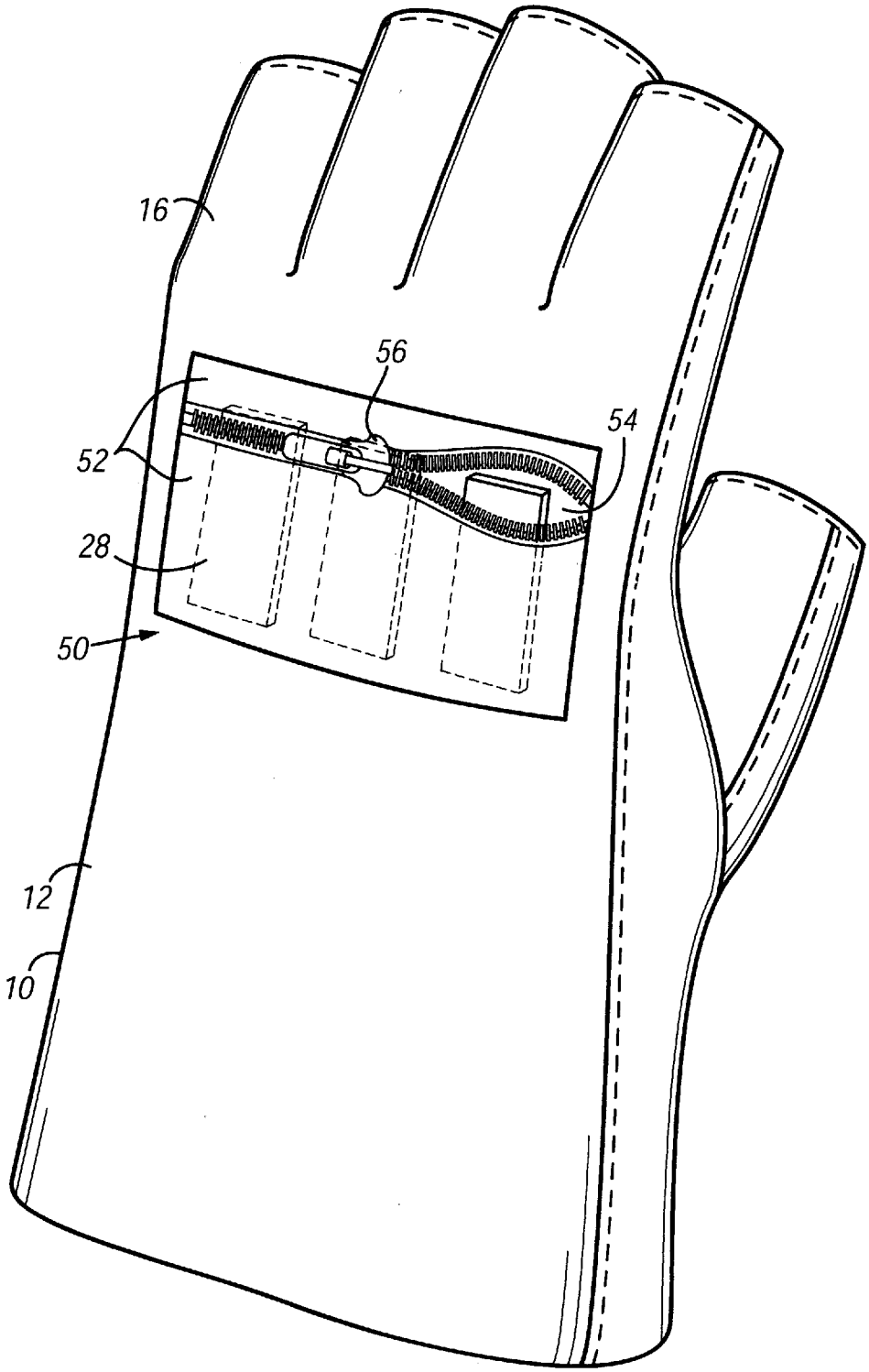
FIG. 5 is a perspective view of another aspect of the magnetized work glove of the present invention, wherein the magnet-retaining pouch has an integral zipper for enabling access to an interior pouch space.

Referring now to FIG. 5, in a further aspect of the invention a magnet-retaining enclosure is provided having the configuration of a pouch 50 including upper and lower sides 52 and 54, respectively, and incorporating a zipper system 56 in the upper side 52. In this manner, the inside of the pouch can be accessed to insert, remove or reposition the magnets 26.

Figure 6B:
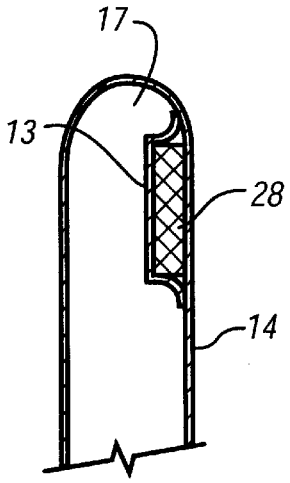
FIG. 6*b* is a cross-sectional view taken along cutting plane 6*b*—6*b* in FIG. 6*a*.
Figure 6A:
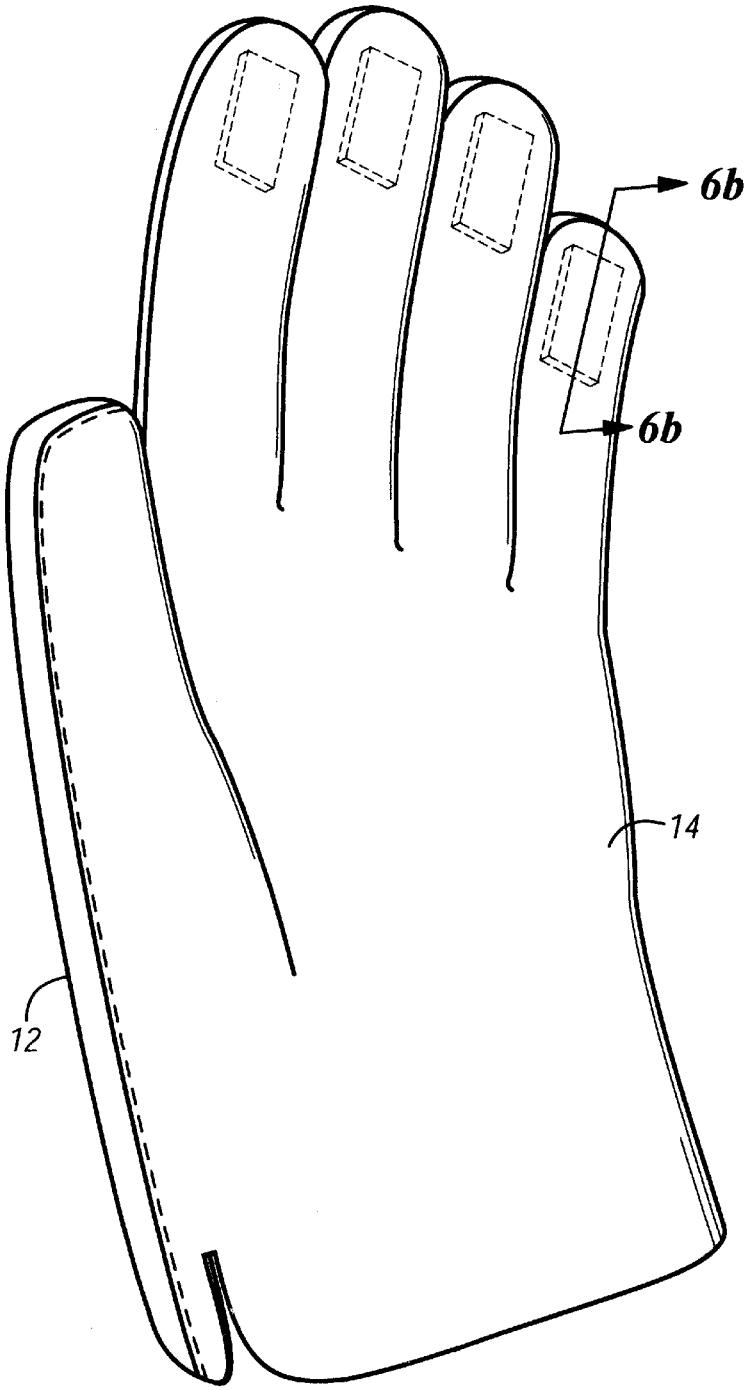
FIG. 6*a* is a perspective view of another aspect of the magnetized work glove of the present invention, wherein magnets are provided at the finger tip portions of the glove for facilitating gripping of components during a construction or assembly operation.

Referring now to FIG. 6, in a further aspect of the invention the glove is provided having one more additional magnets 28 disposed within fingertip portions 17 for maintaining magnetically attracted components to the finger tip portions of the glove during an operation. In this manner, the occurrence of dropped components during an operation is minimized since individual components are magnetically secured against the outer surface of the finger-receiving portions of the glove, even when the wearer loses his grip on a component. Preferably, the fingertip magnets 28 are provided permanently enveloped between glove front side 14 and rear enclosure layer 13 attached peripherally thereto.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A work glove, comprising:

a glove body having a flexible back surface;

a flexible article of material having a periphery fixedly attached to the flexible back surface of said glove body to define a completely enclosed interior space;

a plurality of magnets disposed in spaced-apart relationship within the completely enclosed interior space; and magnet-insulating means disposed within the completely enclosed interior space, said magnet-insulating means constructed and positioned to minimize magnetic interference between adjacent ones of said plurality of magnets and to prevent said plurality of magnets from sliding about within said enclosed interior space.

2. A work glove as recited in claim 1, wherein said magnet-insulating means further comprises one or more flexible substrates interposed between adjacent edges of said plurality of magnets.

3. A work glove as recited in claim 1, wherein said magnet-insulating means further comprises a one-piece flexible substrate having a plurality of apertures extending therethrough, the apertures sized and shaped to have said plurality of magnets snugly received therein.

4. A work glove as recited in claim 1, wherein said magnet-insulating means further comprises a one-piece flexible substrate having a plurality of cavities provided therein, the cavities sized and shaped to have said plurality of magnets snugly seated therein.

5. A work glove as recited in claim 1, further comprising means for selectively accessing said completely enclosed interior space.

6. A work glove, comprising:

a glove body having a flexible back surface;

a flexible two-layer enclosure defining a completely enclosed interior space and having a periphery fixedly attached to the flexible back surface of said glove body;

a plurality of magnets disposed in spaced-apart relationship within the completely enclosed interior space of said flexible enclosure; and magnet-insulating means disposed within the completely enclosed interior space, said magnet-insulating means constructed and positioned to minimize magnetic interference between adjacent ones of said plurality of magnets and to prevent said plurality of magnets from sliding about within said enclosed interior space.

7. A work glove as recited in claim 6, wherein said magnet-insulating means further comprises one or more flexible substrates interposed between adjacent edges of said plurality of magnets.

8. A work glove as recited in claim 6, wherein said magnet-insulating means further comprises a one-piece flexible substrate having a plurality of apertures extending therethrough, the apertures sized and shaped to have said plurality of magnets snugly received therein.

9. A work glove as recited in claim 6, wherein said magnet-insulating means further comprises a one-piece flexible substrate having a plurality of cavities provided therein, the cavities sized and shaped to have said plurality of magnets snugly seated therein.

10. A work glove as recited in claim 6, further comprising means for selectively accessing said completely enclosed interior space.

* * * * *

UNITED STATES PATENT AND TRADEMARK OFFICE

CERTIFICATE OF CORRECTION

PATENT NO. : 6,643,845 B2
APPLICATION NO. : 10/122446
DATED : November 11, 2003
INVENTOR(S) : Thomas J. O'Dea and Thomas S. Jellema It is certified that error appears in the above-identified patent and that said Letters Patent is hereby corrected as shown below:

Column 5, line 7, cancel the text beginning with "1. A work glove, comprising:" and ending "interior space." in column 5, line 19, and insert the following claim:

--Claim 1. A work glove, comprising:
a glove body having a flexible back surface;
a flexible article of material having a periphery permanently stitched to the flexible back surface of said glove body to define a completely enclosed interior space at a position adjacent the knuckle portion of a user's hand when worn;
a plurality of magnets disposed in spaced-apart relationship within the completely enclosed interior space; and magnet-insulating means disposed within the completely enclosed interior space, said magnet-insulating means constructed and positioned to minimize magnetic interference between adjacent ones of said plurality of magnets and to prevent said plurality of magnets from sliding about within said enclosed interior space, with the exterior surface of said flexible article of material providing a substantially planar magnetic surface for receiving and retaining metal components against said exterior surface.--

Signed and Sealed this

Seventh Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 6,643,845 B2
APPLICATION NO. : 10/122446
DATED : November 11, 2003
INVENTOR(S) : Thomas J. O'Dea and Thomas S. Jellema It is certified that error appears in the above-identified patent and that said Letters Patent is hereby corrected as shown below:

Column 6, line 1, cancel the text beginning with "6. A work glove, comprising:" and ending "interior space." in column 6, line 16, and insert the following replacement Claim 6:

Column 6, line 1-16
-- Claim 6. A work glove, comprising:

a glove body having a flexible back surface;

a flexible two-layer enclosure defining a completely enclosed interior space and having a periphery fixedly attached to the flexible back surface of said glove body at a position adjacent the knuckle portion of a user's hand when worn;

a plurality of magnets disposed in spaced-apart relationship within the completely enclosed interior space of said flexible enclosure; and magnet-insulating means disposed within the completely enclosed interior space, said magnet-insulating means constructed and positioned to minimize magnetic interference between adjacent ones of said plurality of magnets and to prevent said plurality of magnets from sliding about within said enclosed interior space, with an exterior surface of an upper one of said two-layer enclosure providing a substantially planar magnetic surface for receiving and retaining metal components against said exterior surface. --

Signed and Sealed this

Thirtieth Day of March, 2010

David J. Kappos

David J. Kappos
*Director of the United States Patent and Trademark Office*